US009950407B2

(12) United States Patent
Matsubara

(10) Patent No.: US 9,950,407 B2
(45) Date of Patent: Apr. 24, 2018

(54) NOZZLE BODY

(71) Applicant: MACOHO CO. LTD., Nagaoka-shi, Niigata (JP)

(72) Inventor: Sachito Matsubara, Nagaoka (JP)

(73) Assignee: MACOHO CO. LTD., Nagaoka-Shi, Niigata (JP)

( * ) Notice: Subject to any disclaimer, the term of this patent is extended or adjusted under 35 U.S.C. 154(b) by 0 days.

(21) Appl. No.: 14/946,120

(22) Filed: Nov. 19, 2015

(65) Prior Publication Data

US 2016/0151883 A1 Jun. 2, 2016

(30) Foreign Application Priority Data

Nov. 29, 2014 (JP) ..... 2014-242656

(51) Int. Cl.
*B24C 5/04* (2006.01)
*B24C 7/00* (2006.01)

(52) U.S. Cl.
CPC ..... *B24C 5/04* (2013.01); *B24C 7/0015* (2013.01)

(58) Field of Classification Search
CPC .... B05B 7/04; B05B 1/00; B05B 1/04; B05B 1/044; B05B 1/06

(Continued)

(56) References Cited

U.S. PATENT DOCUMENTS 5,474,235 A * 12/1995 Cole ..... B05B 1/00 239/431
6,932,285 B1 * 8/2005 Zeng ..... B05B 7/04 175/340

(Continued)

FOREIGN PATENT DOCUMENTS

JP 61-98555 U 6/1986
JP 2001-300363 A 10/2001

(Continued)

OTHER PUBLICATIONS

Translation of JP3540713B2, Matsubara, Nozzle Body, Jul. 7, 2004.*

(Continued)

*Primary Examiner* — Monica Carter
*Assistant Examiner* — Lauren Beronja
(74) *Attorney, Agent, or Firm* — Sughrue Mion, PLLC

(57) ABSTRACT

The purpose of the present invention is to provide a very practical nozzle body. The present invention is a nozzle body in which: a slurry-accumulating chamber (1) having a prescribed length is provided, a slurry formed of a mixture of an abrasive and a liquid being introduced into the slurry-accumulating chamber, and the slurry-accumulating chamber accumulating the slurry; an air-jetting passage (30) having a prescribed length is provided in the vicinity of the slurry-accumulating chamber (1) in a direction perpendicular to a lengthwise direction of the slurry-accumulating chamber (1); the air-jetting passage (30) and the slurry-accumulating chamber (1) are in communication through an output passage (6); pressurized air passes through the air-jetting passage (30), and the slurry is thereby outputted from the slurry-accumulating chamber (1) via the output passage (6); the slurry and the pressurized air are mixed in a mixing chamber (3); and jetting material (4) formed by mixing the pressurized air and the slurry is jetted from a slit-shaped jetting part (5).

8 Claims, 5 Drawing Sheets

(58) Field of Classification Search
USPC ..... 239/597, 434, 533; 451/102
See application file for complete search history.

(56) References Cited

U.S. PATENT DOCUMENTS

| | | | | |
|---|---|---|---|---|
| 7,185,833 | B2 * | 3/2007 | Geskin | B05B 1/02 239/533.1 |
| 2003/0189114 | A1 * | 10/2003 | Taylor | B05B 1/00 239/602 |

FOREIGN PATENT DOCUMENTS

| | | | |
|---|---|---|---|
| JP | 2004-9283 | A | 1/2004 |
| JP | 3540713 | B2 | 7/2004 |
| JP | 4969839 | B2 | 7/2012 |

OTHER PUBLICATIONS

Japanese Office Action corresponding to Japanese Patent Application No. 2014-242656, dated Nov. 4, 2016.

* cited by examiner

NOZZLE BODY

TECHNICAL FIELD

The present invention relates to a nozzle body.

BACKGROUND ART

Various proposals have been put forth in the past for wet-blasting techniques in which a "wet blast" is jetted onto a workpiece from a jetting part, the wet blast being formed by pressurizing with pressurized air a slurry formed of a mixture of an abrasive and a liquid, and machining such as burr processing or an abrasion test or the like is performed on a workpiece using the wet blast. Various nozzle bodies for satisfactorily jetting the wet blast have also been proposed.

In order to uniformly machine the surface of a large workpiece having, for example, a width of 600 mm or the like using a wet-blast technique, means is adopted for preparing a nozzle body for wet-blasting in which the jetting part of the nozzle body is formed in a slit shape having a width of 600 mm or greater, the workpiece is moved relative to the nozzle body, and machining is thereby performed over the entire surface of the workpiece as simultaneously as possible.

However, jetting a wet blast in a uniformly mixed state from the slit-shaped jetting part having such a prescribed width is very troublesome. This is because as the width of the jetting part increases, the concentration of abrasive in the slurry tends to increase and decrease by location.

In response, the present applicants have proposed the nozzle body disclosed in Japanese Patent No. 3540713 (hereinafter referred to as the "conventional art example").

This conventional art example is a nozzle body in which: a slurry-accumulating chamber having a prescribed length is provided, a slurry formed of a mixture of an abrasive and a liquid being introduced into the slurry-accumulating chamber, and the slurry-accumulating chamber accumulating the slurry; an air-jetting passage having a prescribed length is provided near the slurry-accumulating chamber in a direction perpendicular to a lengthwise direction of the slurry-accumulating chamber; the air-jetting passage and the slurry-accumulating chamber are in communication through an output passage; pressurized air passes through the air-jetting passage, and the slurry is thereby outputted from the slurry-accumulating chamber via the output passage; the slurry and the pressurized air are mixed in a mixing chamber; and jetting material formed by mixing the pressurized air and the slurry is jetted from a slit-shaped jetting part. The air-jetting passage and the output passage each have a structure in which small holes are arranged side-by-side, and in this conventional art example, the abrasive, liquid, and pressurized air jetted from the jetting part at a prescribed width can be uniformly mixed.

Patent Document

Patent Document 1: Japanese Patent Publication No. 3540713

DISCLOSURE OF THE INVENTION

Problems to be Solved by the Invention

It was confirmed, however, that striped irregularities occur when processing the surface of a glossy, outwardly visible component (casing) in a computer, mobile phone, or the like using the conventional art example.

These are fine irregularities that cannot be expressed as numerical values, such as machining depth or surface roughness, and are apparent only in light-reflecting conditions when the surface of the body to be processed, which is the processing object, is glossy. It has become clear that these irregularities are definitely not a problem when processing objects that are not outwardly visible components, but are unsatisfactory when processing outwardly visible components.

The present invention provides, as a solution to the above-described problem, an excellent nozzle body that makes it possible to process even a glossy processing surface such as an outwardly visible component without the occurrence of striped irregularities, and has other very practical properties.

Means for Solving the Problem

The main point of the present invention will be described with reference to the annexed drawings.

In a nozzle body according to a first aspect of the invention, a slurry-accumulating chamber 1 having a prescribed length is provided, a slurry formed of a mixture of an abrasive and a liquid being introduced into the slurry-accumulating chamber 1, and the slurry-accumulating chamber 1 accumulating the slurry; an air-jetting passage 30 having a prescribed length is provided in the vicinity of the slurry-accumulating chamber 1 in a direction perpendicular to a lengthwise direction of the slurry-accumulating chamber 1; the air-jetting passage 30 and the slurry-accumulating chamber 1 are in communication through an output passage 6; pressurized air passes through the air-jetting passage 30, and the slurry is thereby outputted from the slurry-accumulating chamber 1 via the output passage 6; the slurry and the pressurized air are mixed in a mixing chamber 3; and jetting material 4 formed by mixing the pressurized air and the slurry is jetted from a slit-shaped jetting part 5; the nozzle body being provided with a slurry introduction part 33 for introducing the slurry into the slurry-accumulating chamber 1, and the slurry introduction 33 part being provided to at least one end part of right and left end parts of the slurry-accumulating chamber 1 in the lengthwise direction.

A nozzle body according to a second aspect of the invention is the nozzle body according to the first aspect of the invention, wherein a slurry introduction part 33 for introducing the slurry into the slurry-accumulating chamber 1 is provided to one end part of right and left end parts of the slurry-accumulating chamber 1 in the lengthwise direction, and a slurry output part 34 for outputting surplus slurry that is not introduced to the output passage 6 is provided to the other end part.

A nozzle body according to a third aspect of the invention is the nozzle body according to the first or second aspect of the invention, wherein the slurry introduction part 33 is provided in an open state to one end surface of the slurry-accumulating chamber 1, and the slurry output part 34 is provided in an open state to the other end surface.

A nozzle body according a fourth aspect of the invention is the nozzle body according to the first aspect of the invention, wherein the opening diameter of the slurry output part 34 is set smaller than the opening diameter of the slurry introduction part 33.

A nozzle body according a fifth aspect of the invention is the nozzle body according to the second aspect of the invention, wherein the opening diameter of the slurry output part 34 is set smaller than the opening diameter of the slurry introduction part 33.

A nozzle body according a sixth aspect of the invention is the nozzle body according to the third aspect of the invention, wherein the opening diameter of the slurry output part 34 is set smaller than the opening diameter of the slurry introduction part 33.

Effect of the Invention

Due to being configured as described above, the present invention is an innovative nozzle body that makes it possible to process even a glossy processing surface such as an outwardly visible component without the occurrence of striped irregularities, and demonstrates other unprecedented effects.

DESCRIPTION OF THE PREFERRED EMBODIMENTS

Figure 1:
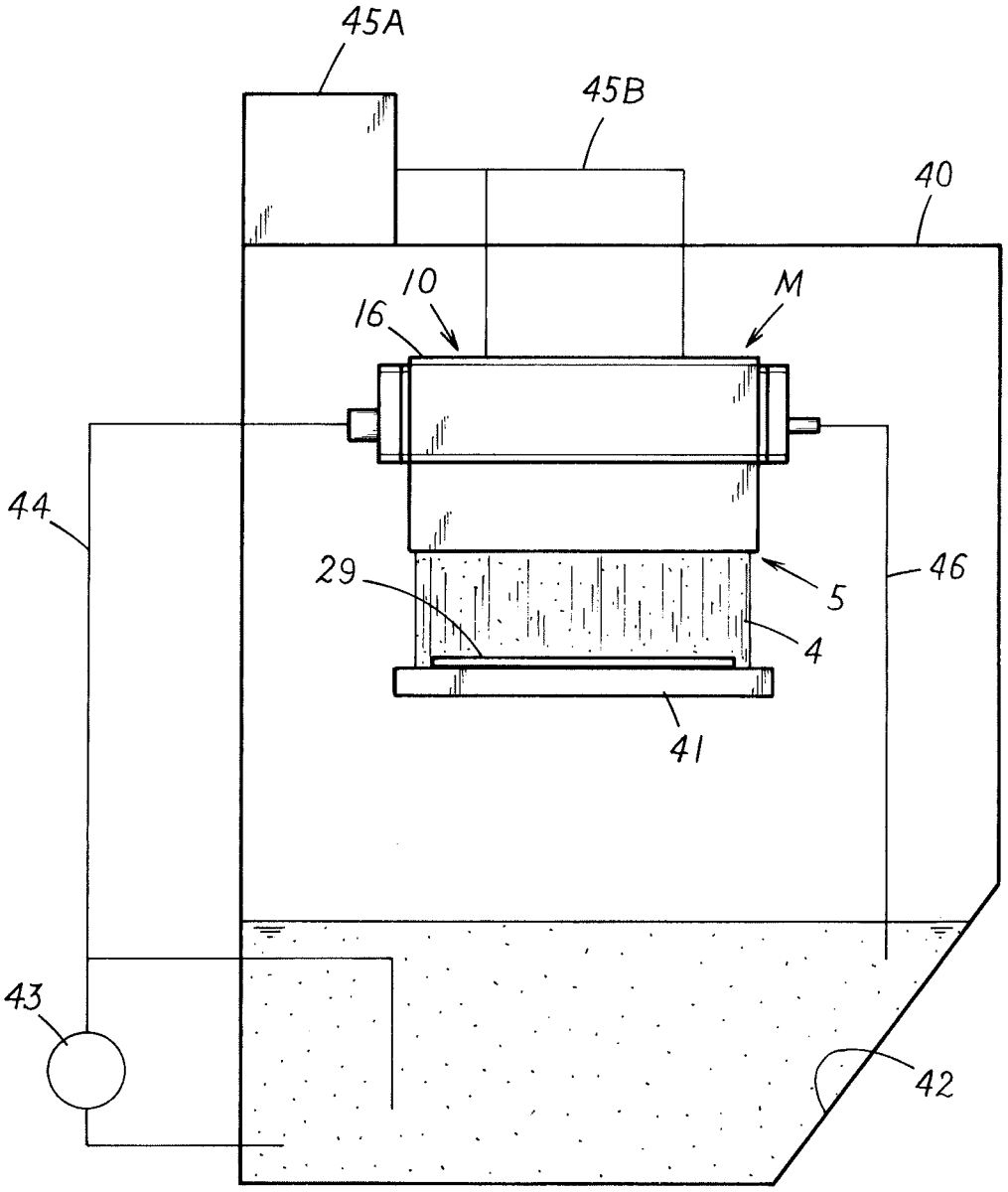
FIG. 1 is an explanatory view of the present example in a state of use.
Figure 2:
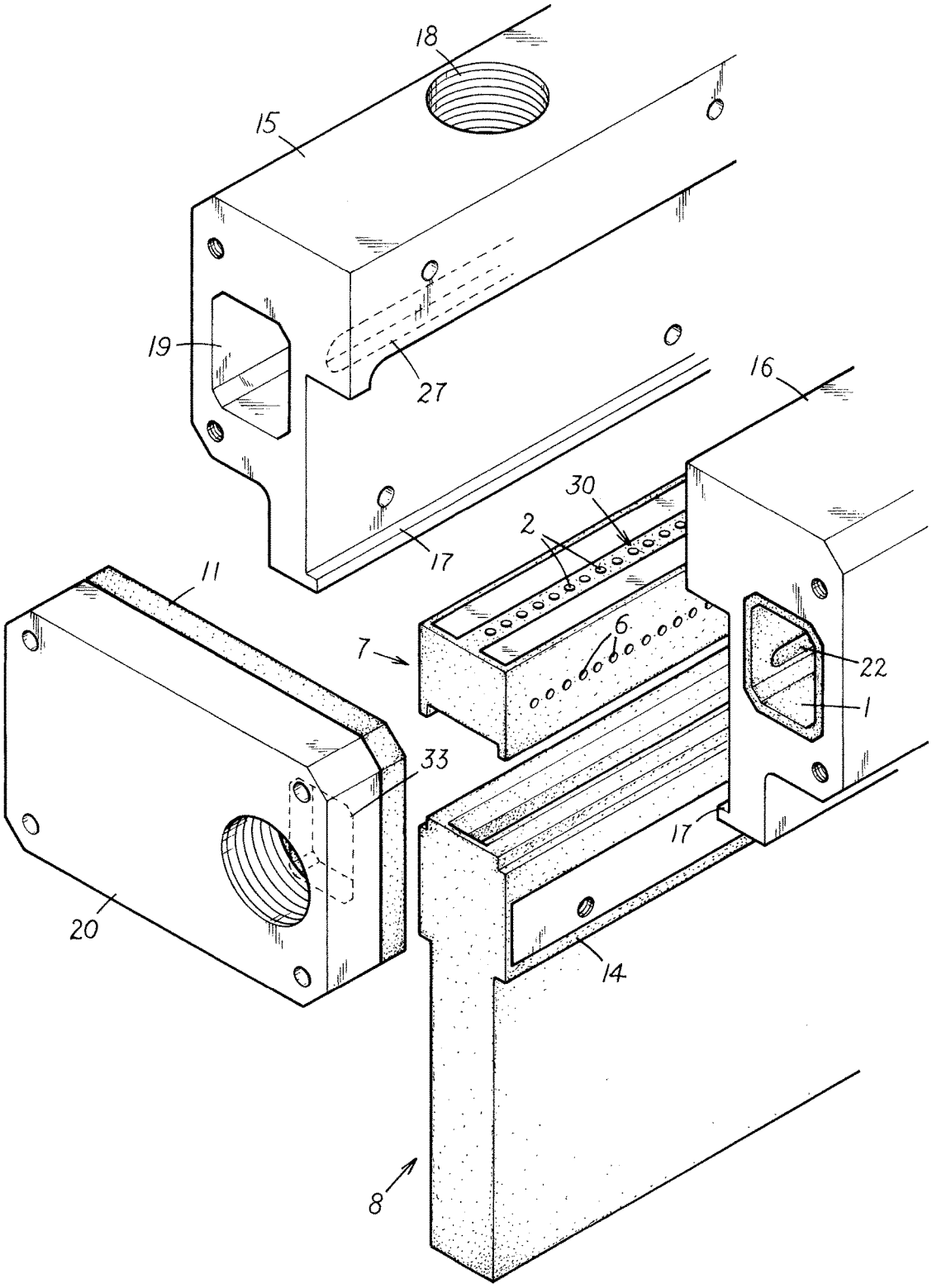
FIG. 2 is an explanatory segmented perspective view of the present example.
Figure 3:
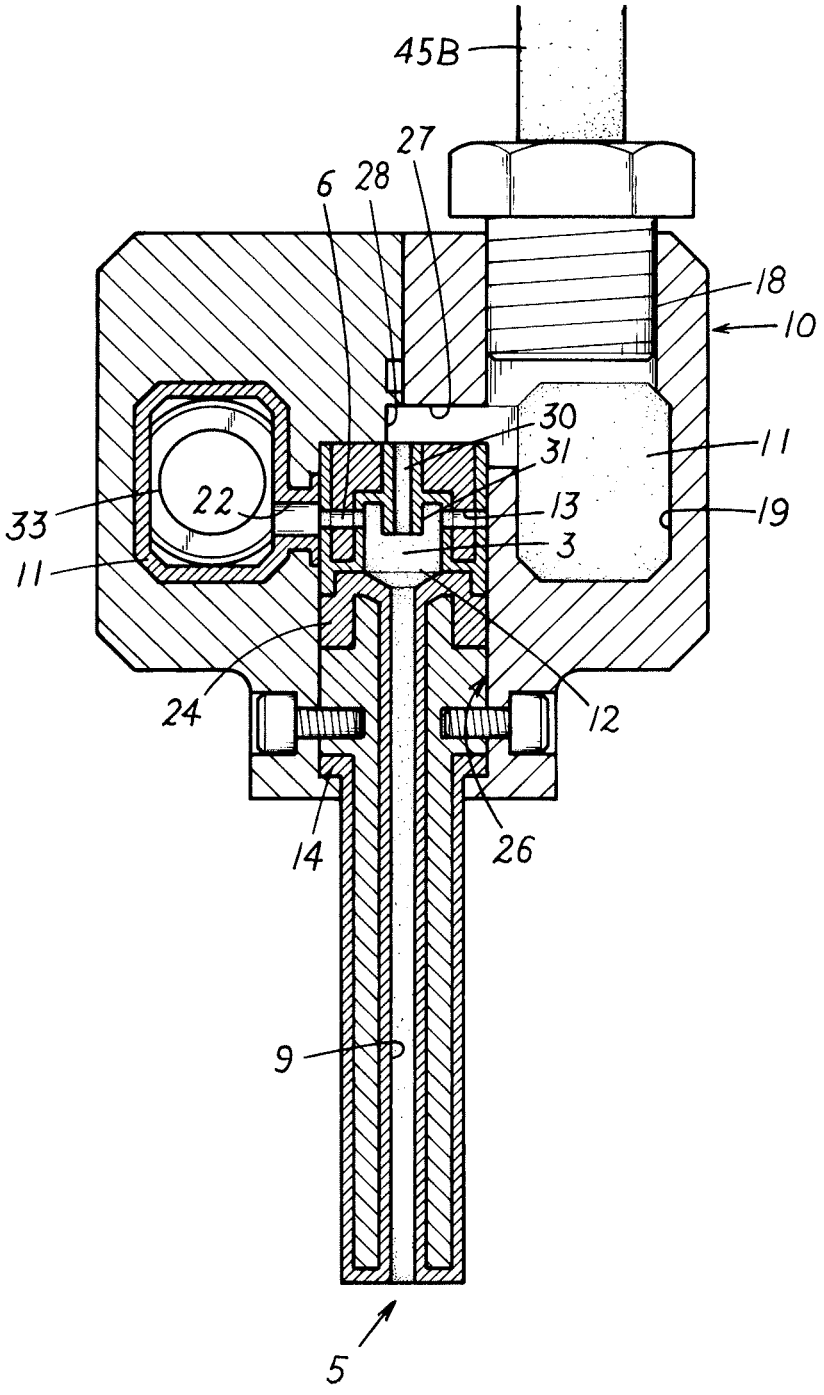
FIG. 3 is an explanatory lateral cross-sectional view of the present example.

Preferred embodiments of the present invention are described merely by indicating the effect of the present invention on the basis of the accompanying drawings.

In the present invention, a slurry formed of an abrasive and a liquid is accumulated in a slurry-accumulating chamber 1, pressurized air passes through an air-jetting passage 30 provided near the slurry-accumulating chamber 1, whereby the slurry is outputted from the slurry-accumulating chamber 1 via an output passage 6, the slurry and pressurized air are mixed in a mixing chamber 3, a jetting material 4 formed by mixing the pressurized air and the slurry is jetted from a slit-shaped jetting part 5, and the jetting material 4 hits a surface of a body to be processed to perform processing.

In relation to the above-described problem of the conventional art example, namely, that striped irregularities occur on the surface when processing a body having a glossy surface, the present inventors focused on the relationship between the nozzle body and the position at which the striped irregularities occur, and confirmed that striped irregularities occur at the position where the slurry introduction part is consecutively connected to the slurry-accumulating chamber. This is presumably because the position where the slurry introduction part is consecutively connected ends up having a slightly higher slurry concentration than other positions, and such striped irregularities occur.

In view of this, the present inventors confirmed that introducing the slurry into the slurry-accumulating chamber 1 from at least one of the end parts of the left and right end parts of the slurry-accumulating chamber 1 in the lengthwise direction, instead of introducing the slurry from the upper side of the slurry-accumulating chamber 1, would remove the striped irregularities.

This was predicted because there is no incidence of a high slurry concentration at the position where the slurry introduction part is consecutively connected, and the slurry concentration in the slurry-accumulating chamber 1 is made as uniform as possible.

EXAMPLES

Specific examples of the present invention will be described on the basis of the drawings.

The present example is a nozzle body M in which: a slurry-accumulating chamber 1 having a prescribed length is provided, a slurry formed of a mixture of an abrasive and a liquid being introduced into the slurry-accumulating chamber, and the slurry-accumulating chamber 1 accumulating the slurry; an air-jetting passage 30 having a prescribed length is provided near the slurry-accumulating chamber 1 in a direction perpendicular to a lengthwise direction of the slurry-accumulating chamber 1; the air-jetting passage 30 and the slurry-accumulating chamber 1 are in communication through an output passage 6; pressurized air passes through the air-jetting passage 30, and the slurry is thereby outputted from the slurry-accumulating chamber 1 via the output passage 6; the slurry and the pressurized air are mixed in a mixing chamber 3; and jetting material 4 formed by mixing the pressurized air and the slurry is jetted from a slit-shaped jetting part 5. The nozzle body M is provided to a surface-processing apparatus provided with a wet-blast processing part for performing wet-blast processing on a body to be processed 29 conveyed by a conveying part 41.

Specifically, the wet-blast processing part is, as illustrated in FIG. 1: provided to a base body 40 through which the body to be processed 29 is passed; equipped with a slurry-jetting part comprising the nozzle body M, a slurry-accumulating part 42 installed in a lower position, and a slurry-conveying part 44 for conveying the slurry from the slurry-accumulating part 42 to the slurry-jetting part via a pump device 43; and configured so that the slurry jetted from the slurry-jetting part is sent to the slurry-accumulating part 42 to be reused. Numeral 45A is a pressurized-air-supplying device, 45B is a pressurized-air-conveying part, and 46 is a slurry-returning/conveying part connected to a slurry output part 34, the slurry-returning/conveying part returning the slurry to the slurry-accumulating part 42.

The nozzle M is configured of a long member 7 that is long in the width direction (left/right direction) and short in the front/rear direction, a plate-shaped member 8 consecutively connected so as to be provided vertically with respect to a lower part of the long member 7, the plate-shaped member 8 being long in the width direction and long in the thickness direction, and a block-shaped fitting member 10 consecutively connected in a fitted state to an upper part of the long member 7, as illustrated in FIG. 2-5.

The mixing chamber 3 is provided to an interior part of the long member 7, the air-jetting passage 30 for introducing pressurized air into the mixing chamber 3 is provided to an upper part of the mixing chamber 3, the output passage 6 is provided to one side part (center left side in FIG. 3) of the mixing chamber 3, and a lower-part opening part 12 arranged in communication with the jetting part 5 is provided to a lower part of the mixing chamber 3.

A protrusion 31 is vertically provided on an upper-part inner wall of the mixing chamber 3, and a mixing chamber 3-side opening part of the air-jetting passage 30 is provided to a lower end part of the protrusion 31. The mixing chamber 3-side opening part of the air-jetting passage 30 is set so as to be positioned lower than the mixing chamber 3-side opening part of the output passage 6. When pressurized air is supplied to the mixing chamber 3 from the air-jetting passage 30 using this configuration, the pressure of the space between the mixing chamber 3-side opening part of the air-jetting passage 30 and the mixing chamber 3-side opening part of the output passage 6 is negative due to the movement of the pressurized air passing through in a downward direction. The slurry is thereby drawn in from the mixing chamber 3-side opening part of the output passage 6 and outputted into the mixing chamber 3, and the slurry and the pressurized air are mixed in the mixing chamber 3.

The other side part (center right side in FIG. 3) of the mixing chamber 3 and the one side part (center left side in FIG. 3) of the mixing chamber 3 are formed having the same structure (porous structure in which small holes 13 are arranged side-by-side). This is done in order to make the long member 7 have a shape that is front/back symmetrical, and to provide excellent assembling properties to the long member 7. That is, even if the front and back of the long member 7 are reversed and the plate-shaped member 8 and the fitting member 10 are integrated, the output passage 6 can always be provided.

In addition, the air-jetting passage 30 is provided with a porous structure in which small holes 2 are arranged side-by-side, in a manner similar to the output passage 6. The structure of the air-jetting passage 30 is the configuration adopted in Japanese Patent Publication No. 3540713 as well.

The plate-shaped member 8 has a slit-shaped passing route 9 arranged in communication with the lower-part opening part 12 of the mixing chamber 3, the passing route 9 being provided to an interior part of the plate-shaped member 8. A lower part of the passing route 9 is open, and the opening is set in the slit-shaped jetting part 5.

In addition, a projecting part 14 is provided to each of lower-part front and back surfaces of the plate-shaped member 8.

The fitting member 10 is configured of a first member 15 and a second member 16, and a holding/locking part 17 for locking the projecting part 14 of the plate-shaped member 8 in a held state is provided to each of lower parts of the first member 15 and the second member 16.

In addition, a recessed part 26 that makes it possible to maintain the long member 7 and an upper part of the plate-shaped member 8 in a sandwiched state is provided to the fitting member 10 when the first member 15 and the second member 16 are assembled.

In the first member 15, an air introduction port 18 for introducing air is provided to an upper part thereof; an air accumulation chamber 19 for temporarily accumulating air is provided to an interior part thereof, the air accumulation chamber 19 being in communication with the air introduction port 18; and an air-passing part 27 is provided to the area coming into contact with the upper part of the long member 7 when the second member 16 is fitted to the first member 15, the air-passing part 27 causing there to be communication from the air accumulation chamber 19 to the air-jetting passage 30 of the long member 7.

In the second member 16, the slurry-accumulating chamber 1 for accumulating the slurry is provided to the interior part thereof in the lengthwise direction, and a slurry introduction part 33 for introducing the slurry is provided to one end part of the right and left end parts of the slurry-accumulating chamber 1.

The slurry introduction part 33 has a configuration in which a through-hole is provided to an end member 20 joined to one end part of the fitting member 10, the slurry introduction part 33 being provided in an open state to one end surface of the slurry-accumulating chamber 1. The slurry-conveying part 44 is connected to the slurry introduction part 33.

In addition, a slurry-passing route 22 is provided to an area that comes into contact with one side part (side where the output passage 6 is provided) of the long member 7 when the first member 15 is fitted to the second member 16, the slurry-passing route 22 causing there to be communication from the slurry-accumulating chamber 1 to the output passage 6 of the long member 7.

Figure 4:
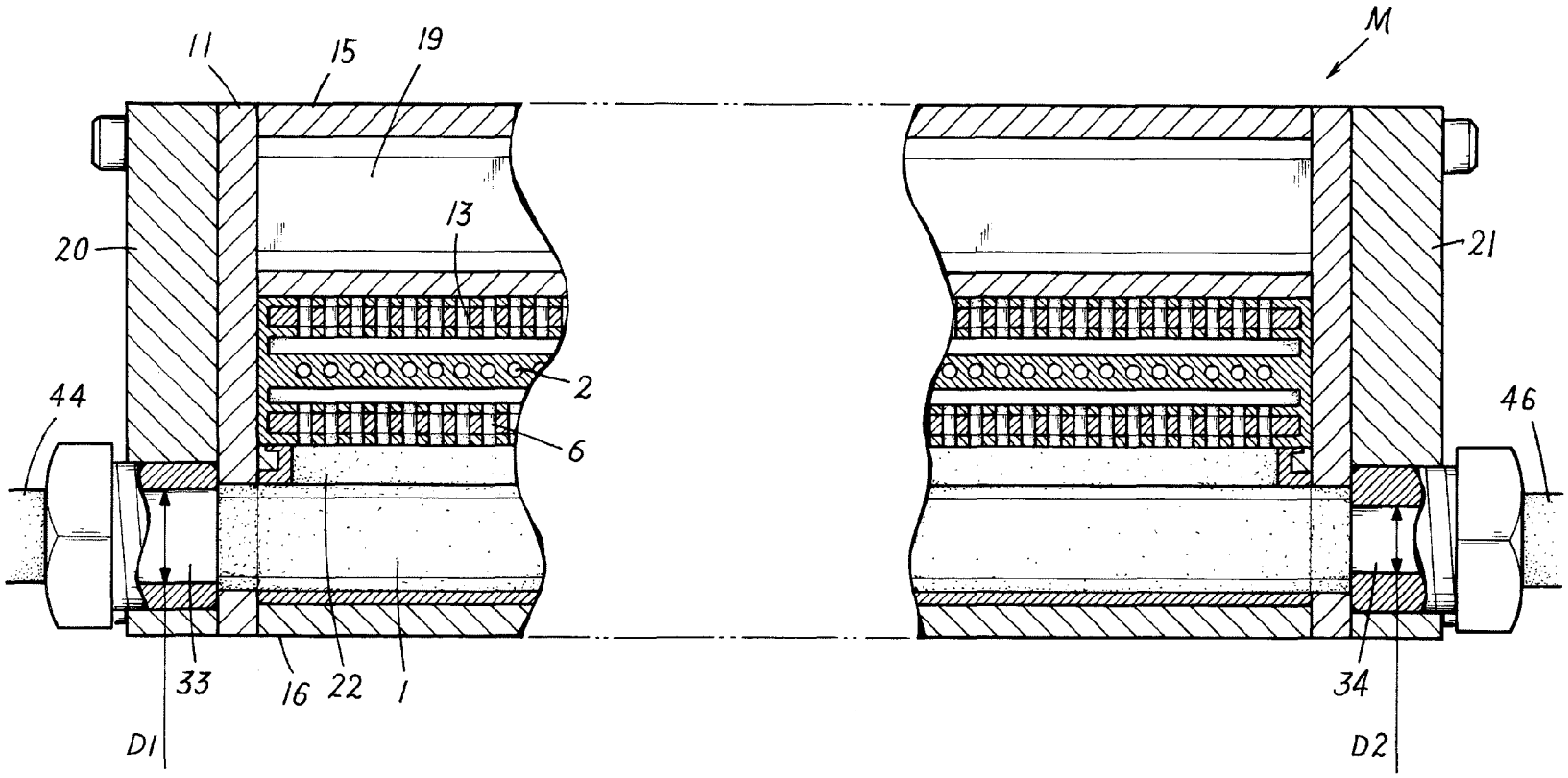
FIG. 4 is an explanatory horizontal cross-sectional view of the present example.
Figure 5:
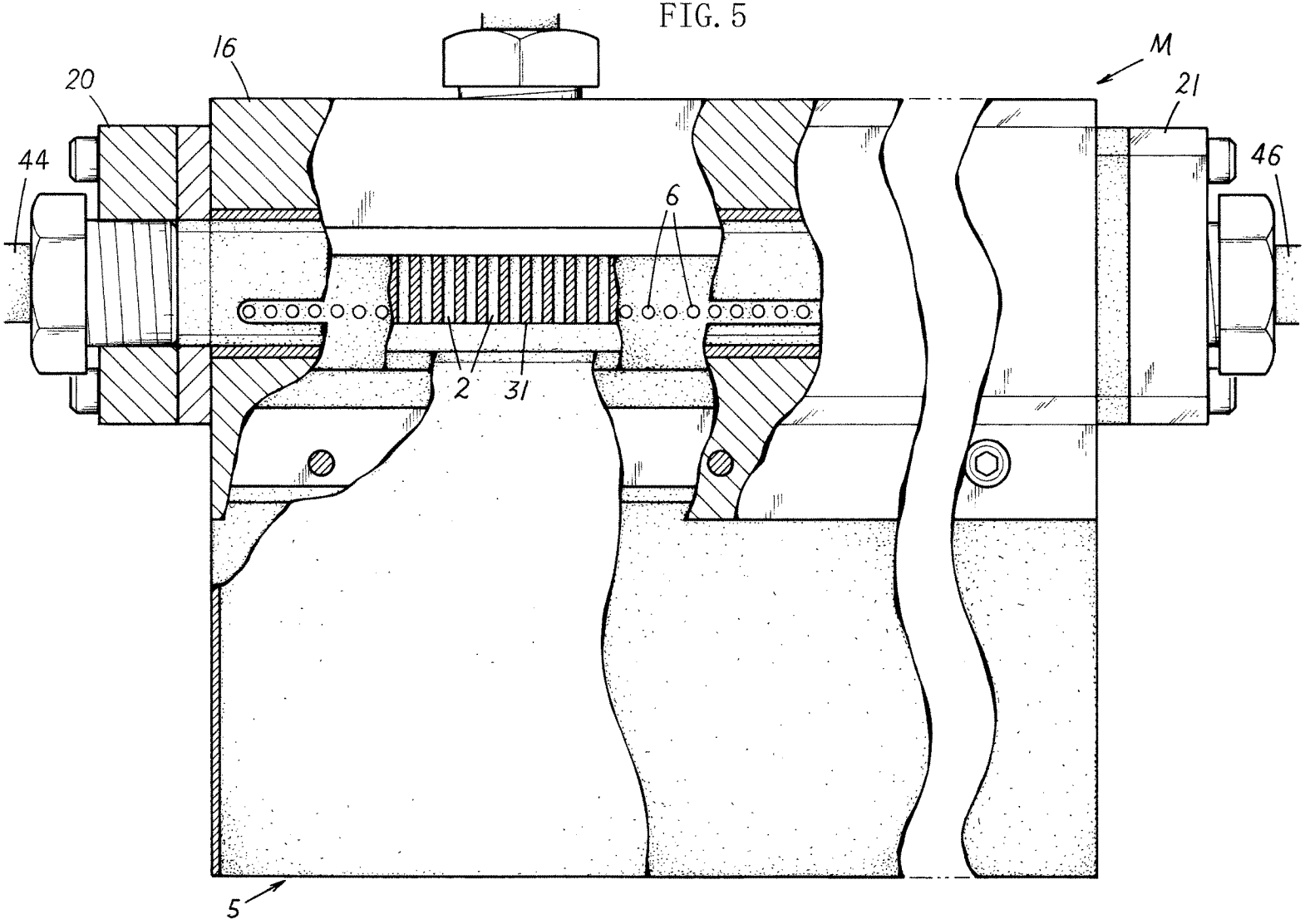
FIG. 5 is an explanatory longitudinal cross-sectional view of the present example.

In addition, the slurry output part 34 is, as illustrated in FIG. 4, provided to the other end part of the right and left end parts of the slurry-accumulating chamber 1.

The slurry output part 34 has a configuration in which a through-hole is provided to an end member 21 joined to the other end part of the fitting member 10, the slurry output part 34 being provided in an open state to the other end surface of the slurry-accumulating chamber 1. The slurry-returning/conveying part 46 is connected to the slurry output part 34.

The slurry output part 34 outputs surplus slurry not introduced to the output passage 6.

In addition, in the present example, the opening diameter D2 of the slurry output part 34 is set smaller than the opening diameter D1 of the above-described slurry introduction part 33. Specifically, the opening diameter D1 of the slurry introduction part 33 is 18 mm, and the opening diameter D2 of the slurry output part 34 is 15 mm. In this sense, surface processing of the body to be processed has been performed at an opening diameter D2 of the slurry output part 34 of 7 mm and 12 mm, but the best processing, in which striped irregularities do not occur, is performed in cases in which the opening diameter D2 is 15 mm.

In addition, an air-passing part 28 is provided to an area that comes into contact with the upper part of the long member 7 when the first member 15 is fitted to the second member 16, an air-passing route is configured of the air-passing part 28 and the air-passing part 27 of the first member 15, and the air-passing route causes there to be communication from the air accumulation chamber 19 to the air-jetting passage 30 of the long member 7.

In the present example, the first member 15 is provided to the back side of the long member 7, and the second member 16 is provided to the front side of the long member 7, but the result is the same if the first member 15 is provided to the front side of the long member 7, and the second member 16 is provided to the back side of the long member 7.

In addition, the mixing chamber 3 is provided in a through state to the long member 7 in the right/left direction, and further, the air accumulation chamber 19 and the slurry-accumulating chamber 1 are each provided in a through-state to the fitting member 10 in the right/left direction. Accordingly, the mixing chamber 3, the air accumulation chamber 19, and the slurry-accumulating chamber 1 can be provided by simple machining means, such as forming a through-hole. Right and left opening parts of the mixing chamber 3 and the air accumulation chamber 19 are blocked by the above-described end members 20, 21.

In addition, the long member 7, the plate-shaped member 8, the fitting member 10, and the end members 20, 21 are formed of a raw material, for example, a metal material, that as much as possible does not dimensionally deform.

In addition, within each of the abovementioned configurations, a protective layer 11 made of urethane resin covers the route through which the slurry passes (inner walls of the slurry-accumulating chamber 1, inner walls of the slurry-passing route 22, inner walls of the output passage 6, inner walls of the mixing chamber 3, inner walls of the passing route 9, vicinity of the jetting part 5, and blocking-side surfaces of the end members 20, 21). The protective layer 11 prevents the route through which the slurry passes from being polished by the slurry (particularly, the abrasive), and the life of the nozzle M is confirmed to be extended many-fold due to the presence of the protective layer 11.

In addition, the urethane resin is also provided as a sealing member 24 to the areas to which each of the follow members come into contact: the long member 7, the plate-shaped member 8, the fitting member 10, and the end members 20, 21.

In addition, a configuration is adopted in which the urethane resin is as much as possible not provided to the route through which only the pressurized air passes (the inner walls of the air accumulation chamber 19, the inner walls of the air-passing route, and the air-jetting passage 30). This is because the urethane resin has a large surface friction resistance, and thus when urethane resin is present, the pressurized air loses pressure due to contact between the urethane resin and the pressurized air.

Because of the above configuration, in cases in which the output passage for outputting the slurry from the slurry-accumulating chamber 1 has a long slit structure, the pressure of the slurry passing through the output passage is not uniform in the long direction, and the longer the slit, the less uniform the pressure becomes. It is thought, however, that when the output passage 6 is a porous structure in which the small holes 13 are arranged side-by-side, as in the present example, the pressure of the slurry passing through the small holes 13 is uniform in the small holes 13. Moreover, when the slurry is sent from the slurry-accumulating chamber 1 to the output passage 6, the small holes 13 function as orifices and the output of the slurry is throttled (the pressure is increased), allowing the pressure passing through the small holes 13 in the entire output passage 6 to be uniform. Accordingly, the slurry in the entire output passage 6 is sent to the mixing chamber 3 in a uniform manner, resulting in the jetting material 4 having the slurry and the pressurized air mixed in a uniform mixed state in the mixing chamber 3, and the jetting material 4 can be jetted from the slit-shaped jetting part 5.

In addition to the pressure passing through the small holes 13 being uniform in the entire output passage 6, the cross-sectional area of the output passage is large when the output passage is a long slit structure, the slurry passing through the output passage is therefore in a turbulent state, and the passing rate of the slurry differs by location; whereas when the output passage 6 is a porous structure in which the small holes 13 are arranged side-by-side, as in the present invention, it is thought that each of the small holes 13 has a small cross-sectional area, and the slurry passing through the small holes 13 is therefore in a streamlined state. Accordingly, the passing rate of the slurry in one of the small holes 13 does not, for example, differ with a change in location, and moreover, the slurry passes through all of the small holes 13 in a streamlined state. The passing rate of the slurry passing through the entire output passage 6 is therefore as uniform as possible without, for example, differing according to location. A slurry having uniform concentration is thereby outputted to the mixing chamber 3, mixed with the pressurized air in the mixing chamber 3 in a uniform mixed state, and jetted from the slit-shaped jetting part 5 as a uniformly mixed jetting material 4.

It is confirmed that this effect can be obtained even if the small holes 13 are not circular in cross-section, as illustrated, and may be various shapes, such as elliptical holes in cross-section, rectangular holes in cross-section, or square holes in cross-section.

Because the present invention was configured as described above, the slurry formed of a mixture of an abrasive and a liquid is introduced to the slurry-accumulating chamber 1 and accumulated, pressurized air passing through the air-jetting passage 30 provided in the vicinity of the slurry accommodation chamber 1 allows the slurry to be outputted from the slurry-accumulating chamber 1 via the output passage 6, the slurry and pressurized air are sent to the mixing chamber 3 and mixed, the jetting material 4 formed by mixing the pressurized air and the slurry is jetted from the slit-shaped jetting part 5, and the jetting material 4 hits the surface of the body to be processed to perform processing.

At this time, the slurry is introduced into the slurry-accumulating chamber 1 from the slurry introduction part 33 provided to one end part of the right and left end parts of the slurry-accumulating chamber 1 in the lengthwise direction, and surplus slurry not introduced to the output passage 6 is outputted to the outside of the slurry-accumulating chamber 1 from the slurry output part 34 provided to the other end part of the slurry-accumulating chamber 1.

In reality, when processing the body to be processed equipped with a glossy surface using each of the nozzles M according to the present example, excellent processing could be performed without the occurrence of striped irregularities.

In addition, the present inventors: prepared a structure (hereinafter referred to as "structure 1") in which the slurry introduction part is provided to each of the right and left end parts of the slurry-accumulating chamber 1 in the lengthwise direction, a structure (hereinafter referred to as "structure 2") in which the slurry introduction part is provided to only one of the end parts of the right and left end parts of the slurry-accumulating chamber 1 in the lengthwise direction, and a structure (hereinafter referred to as "structure 3") in which the slurry introduction part 33 is provided to one of the end parts of the right and left end parts of the slurry-accumulating chamber 1 in the lengthwise direction, and the slurry output part 34 for outputting the surplus slurry that does not pass through the output passage 6 is provided to the other end part; performed excellent process in comparison with any of the conventional art examples when processing a body to be processed equipped with a glossy surface using each of the nozzle bodies equipped with structures 1-3, respectively; and moreover, achieved the most excellent processing without the occurrence of striped irregularities using the nozzle body equipped with structure 3. This is predicted because no phenomenon occurs in which the slurry concentration at the position where the slurry introduction part is consecutively connected is high, and the slurry concentration in the slurry-accumulating chamber 1 is made as uniform as possible.

Moreover, it is thought that, in structure 1, the slurry is introduced from the slurry introduction part provided to each of the right and left end parts of the slurry-accumulating chamber 1 in the lengthwise direction, and the concentration in the center portion of the slurry-accumulating chamber 1 is therefore increased slightly; in structure 2, when the slurry is introduced from the slurry introduction part 33 provided to one of the end parts of the slurry-accumulating chamber 1, the concentration in the end part provided with the slurry introduction part or the end part opposite thereof increases slightly according to the balance of the total surface area in the slurry introduction part 33 and the output passage 6; and in this respect, in structure 3, the slurry introduction part 33 is provided to one of the ends of the right and left end parts of the slurry-accumulating chamber 1 in the lengthwise direction, and the slurry output part 34 (slurry output part 34 provided with an opening part having a smaller diameter than the opening diameter of the slurry introduction part 33) for outputting surplus slurry that is not introduced to the output passage 6 is provided to the other end part, whereby the balance of the total surface area in the slurry introduction part 33, the slurry output part 34, and the output passage 6 is made appropriate, and the concentration (pressure) distribution of the slurry in the slurry-accumulating chamber 1 can be made more uniform.

According to the present example, processing can be performed even on a glossy processing surface, for example, an outwardly visible component, without the occurrence of striped irregularities.

In addition, the present example makes it possible to jet the uniform jetting material 4 from the entire jetting part 5 even if the jetting part 5 is long.

In addition, partitions positioned between the small holes 13 achieve a reinforcing effect, and therefore dimensional deformation of the output passage 6 is prevented as much as possible.

Moreover, the nozzle M having this structure is also confirmed to have significantly less energy loss in the pressurized air (in cases in which the air pressure of the pressurized air and the flow rate of the jetting material 4 are compared, the flow rate of the jetting material 4 is, for example, not remarkably reduced). This point also is predicted by the same reasons as those for slurry uniformity.

That is, the air-jetting passage 30 is provided to a porous structure in which small holes 13 are arranged side-by-side, and the small holes 13 therefore function as orifices; moreover, the pressurized air passing through the air-jetting passage 30 passes through in a streamlined state, and the flow rate of the pressurized air is greater and more constant relative to the pressure of the pressurized air than in cases in which the pressurized air passes through in a turbulent state; and the jetting material 4 formed by mixing the pressurized air and the slurry and used for jetting is optimally jetted onto a workpiece, allowing uniform machining, inspection, and the like to be carried out over the entire surface of the workpiece.

Moreover, when changing the pressure of the pressurized air or the type of the slurry (material or diameter of abrasive; material, etc. of the liquid) in order to correspond to different machining conditions, the shape of the output passage 6, the air-jetting passage 30, and the mixing chamber 3 should be changed, but in this case, all of the output passage 6, the air-jetting passage 30, and the mixing chamber 3 are provided to the long member 7, and therefore by converting only the long member 7, a nozzle member M corresponding differing machining conditions can be simply obtained.

Moreover, the protective layer 11 made of urethane resin is provided to the route through which the slurry passes, and the route through which the slurry passes is therefore strengthened against polishing, deterioration of the route through which the slurry passes is prevented, and a nozzle M having a long life is achieved.

Moreover, the sealing member 24 can be provided integrally with the protective layer 11, and airtight properties at joining locations for the long member 7 and the plate-shaped member 8, etc. can be remarkably increased due to the presence of the sealing member 24.

In addition, according to the present example, very excellent effects are realized, such as uniformly jetting the jetting material 4 from the jetting part 5, and moreover, reducing energy loss in the pressurized air; and a nozzle M is achieved having very excellent practical properties and making it possible to uniformly machine a workpiece even using a very long jetting part 5 that has a width of 600 mm The present invention is not limited to these examples, and the specific configuration of constituent elements can be designed as appropriate.

The invention claimed is:

1. A nozzle body in which: a slurry-accumulating chamber having a prescribed length is provided, a slurry formed of a mixture of an abrasive and a liquid being introduced into the slurry-accumulating chamber, and the slurry-accumulating chamber accumulating the slurry; an air-jetting passage having a prescribed length is provided in a vicinity of the slurry-accumulating chamber in a direction perpendicular to a lengthwise direction of the slurry-accumulating chamber; the air-jetting passage and the slurry-accumulating chamber are in communication through an output passage; pressurized air passes through the air-jetting passage, and the slurry is thereby outputted from the slurry-accumulating chamber via the output passage; the slurry and the pressurized air are mixed in a mixing chamber; and jetting material formed by mixing the pressurized air and the slurry is jetted from a slit-shaped jetting part; the nozzle body comprising:

a slurry introduction part for introducing the slurry into the slurry-accumulating chamber, the slurry introduction part being provided to at least one end part of right and left end parts of the slurry-accumulating chamber in the lengthwise direction, and the slurry introduction part comprising a through-hole wherein an axis of the through-hole is parallel to the lengthwise direction, wherein a slurry output part for outputting surplus slurry that is not introduced to the output passage is provided to another end part of right and left end parts of the slurry-accumulating chamber in the lengthwise direction, and an opening diameter of a slurry output part is set smaller than an opening diameter of the slurry introduction part.

2. The nozzle body according to claim 1, wherein the slurry introduction part is provided in an open state to one end surface of the slurry-accumulating chamber, the one end surface substantially perpendicular to the lengthwise direction, and the slurry output part is provided in an open state to the other end surface.

3. The nozzle body according to claim 1, wherein the slurry output part comprises a second through-hole wherein an axis of the second through-hole is parallel to the lengthwise direction.

4. The nozzle body according to claim 1, wherein an end member is provided to the at least one end part of right and left end parts of the slurry-accumulating chamber in the lengthwise direction, the end member comprising the through-hole.

5. The nozzle body according to claim 4, wherein a second end member is provided to the other end part of right and left end parts of the slurry-accumulating chamber in the lengthwise direction, the second end member comprising a second through-hole.

6. The nozzle body according to claim 3, wherein a second end member is provided to the other end part of right and left end parts of the slurry-accumulating chamber in the lengthwise direction, the second end member comprising the second through-hole.

7. The nozzle body according to claim 1, wherein a slurry-passing route is provided to an area that comes into contact with a long member which comprises the output passage, the slurry-passing route between the slurry-accumulating chamber and the output passage.

8. The nozzle body according to claim 7, wherein a flowing direction of slurry introduced to the slurry-passing route is substantially perpendicular to the lengthwise direction.

* * * * *